US006317987B1

(12) United States Patent
Joung

(10) Patent No.: US 6,317,987 B1
(45) **Date of Patent: *Nov. 20, 2001**

(54) SCISSOR

(75) Inventor: Jin Gu Joung, Seoul (KR)

(73) Assignee: Chan Yong Cheong, Seoul (KR); a part interest ( * ) Notice: Subject to any disclaimer, the term of this patent is extended or adjusted under 35 U.S.C. 154(b) by 0 days.

This patent is subject to a terminal disclaimer.

(21) Appl. No.: 09/525,936

(22) Filed: Mar. 15, 2000

(30) Foreign Application Priority Data

Jul. 19, 1999 (KR) ..... 99-14230

(51) Int. Cl.[7] ..... B26B 13/04; B26B 13/18
(52) U.S. Cl. ..... 30/236; 30/234; 30/253
(58) Field of Search ..... 30/232–236, 253

(56) References Cited

U.S. PATENT DOCUMENTS 415,216 * 11/1889 McDonough ..... 30/253
1,299,104 * 4/1919 Arnold ..... 30/253

* cited by examiner

*Primary Examiner*—Douglas D Watts
(74) *Attorney, Agent, or Firm*—Jones, Tullar & Cooper, P.C.

(57) ABSTRACT

Disclosed is a scissor. The scissor comprises a pair of gripping sections integrally coupled with each other at one ends thereof; a pair of blade sections formed at the other ends of the pair of gripping sections, respectively; and a pair of safety plates securely fastened to outer surfaces of the pair of blade sections, respectively, for separating fabric or sheet material from the pair of blade sections.

3 Claims, 3 Drawing Sheets

SCISSOR

BACKGROUND OF THE INVENTION

1. Field of the Invention

The present invention relates to a scissor used for shearing, severing or cutting fabric, paper, leather, etc. and more particularly, the present invention relates to a scissor which is used to remove waste portions of thread exposed to the outside after fabric is sewn and can eliminate the possibility of a pair of sharp edges from cutting fabric when performing a thread-cutting operation.

2. Description of the Related Art

Generally, cloth which has undergone a sewing work, necessarily includes waste portions of thread. Because these waste portions of the thread deteriorate an outer appearance and quality of an end product, they need to be removed.

A scissor which is used for removing such waste portions of thread, comprises a body which is curved to define a U-shaped configuration. The body forms a pair of gripping sections and a pair of blade sections which are integrally connected to distal ends of the pair of gripping sections, respectively.

In the scissor, the pair of blade sections which are maintained in a state wherein they are diverged by means of an elastic force inherent in the pair of gripping sections, are moved toward each other by bringing together the pair of gripping sections when performing a thread-cutting operation, thereby to cut the waste portions of the thread. After the waste portions of the thread are cut, the pair of gripping sections are released, and by this, the pair of blade sections are returned to their diverged state by the elastic returning force of the pair of gripping sections, to thereby be ready for a next thread-cutting operation. Consequently, the scissor constructed as mentioned above provides an advantage in that it enables a thread-cutting operation to be quickly implemented.

However, the scissor constructed as mentioned above suffers from defects in that, since fabric can be inadvertently intervened between the pair of blade sections while thread-cutting operations are rapidly implemented for removing waste portions of thread, the likelihood of the fabric being cut along with the waste portions of the thread by the scissor is increased.

Because these thread-cutting operations are implemented in a final step of a procedure for producing clothes, if the above-described situation takes place, an end product cannot but be classified into inferior goods, thereby causing an enormous economical loss.

Further, due to the fact that pointed tips and sharp edges of the pair of blade sections are exposed to the outside while not being covered by any special covering members, the scissor can raise a safety issue by the relatively long sharp edges and pointed tips of the pair of blade sections.

SUMMARY OF THE INVENTION

Accordingly, the present invention has been made in an effort to solve the problems occurring in the related art, and an object of the present invention is to provide a scissor which prevents fabric from being intervened between a pair of blade sections thereof when performing a thread-cutting operation, whereby the likelihood of the fabric being inadvertently cut by the scissor is minimized.

In order to achieve the above object, according to the present invention, there is provided a scissor comprising a pair of gripping sections integrally coupled with each other at one end thereof; a pair of blade sections formed at the other end of the pair of gripping sections, respectively; and a pair of safety plates securely fastened to outer surfaces of the pair of blade sections, respectively, for separating fabric or sheet material from the pair of blade sections.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
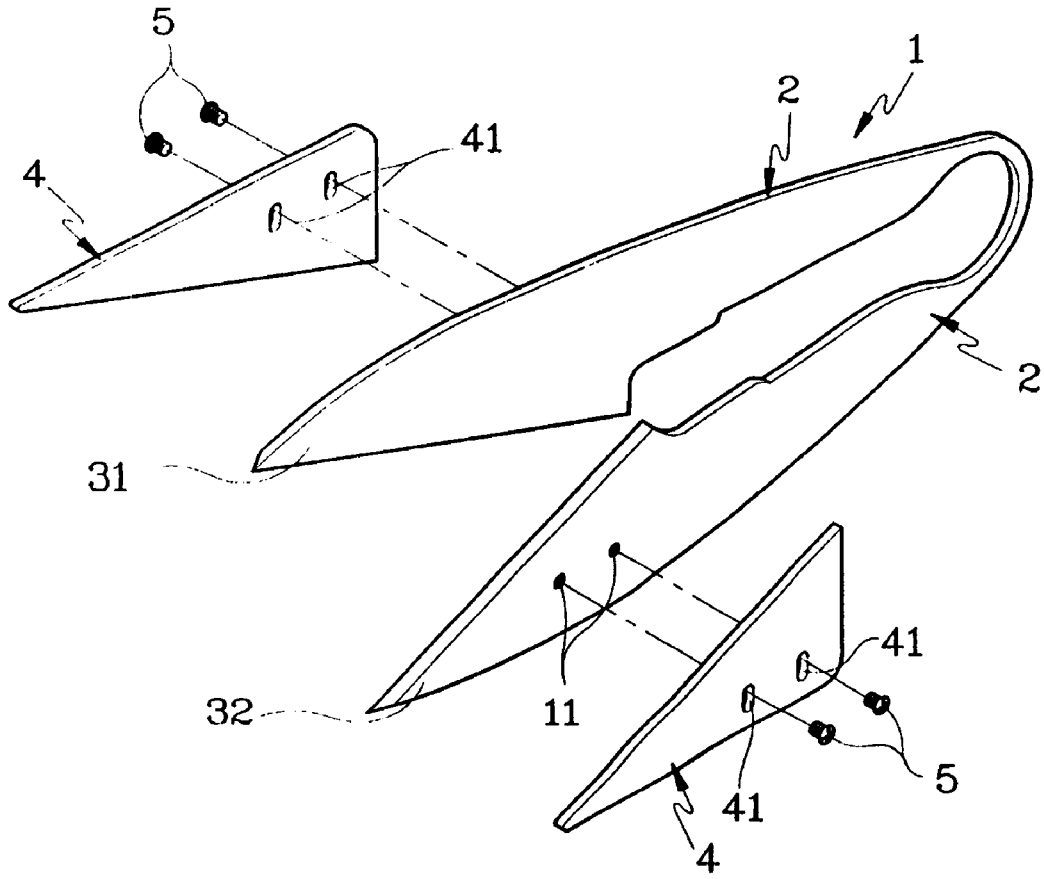
FIG. 1 is an exploded perspective view illustrating a scissor in accordance with a first embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is an exploded perspective view illustrating a scissor in accordance with a first embodiment of the present invention.

As shown in FIG. 1, the scissor 1 according to the present invention has a pair of gripping sections 2, a pair of blade sections 31 and 32, and a pair of safety plates 4. The pair of gripping sections 2 are integrally coupled with each other at one end thereof. The pair of blade sections 31 and 32 are formed at the other end of the pair of gripping sections 2, respectively. The pair of safety plates 4 are securely fastened to outer surfaces of the pair of blade sections 31 and 32, respectively, for separating fabric from the pair of blade sections 31 and 32. In the present invention, the pair of safety plates 4 are formed in a manner such that they have a contour which is substantially the same as that of the pair of blade sections 31 and 32 of the scissor 1.

Further, while a variety of fastening means can be used for fastening each safety plate 4 to each blade section 31 or 32, in this first preferred embodiment of the present invention, the fastening means comprises a pair of through holes 41 which are defined in each safety plate 4, a pair of threaded holes 11 which are formed in each blade section 31 or 32, and a pair of bolts 5 which are screwed into the pair of threaded holes 11 after passing through the pair of through holes 41, respectively.

At this time, the pair of threaded holes 11 which are formed on the outer surface of each blade section 31 or 32, have a predetermined depth so that they do not extend through an inner surface of each blade section 31 or 32 and are closed at one end thereof by the inner surface of each blade section 31 or 32.

Moreover, it is preferred that each safety plate 4 which is fastened to the outer surface of each blade section 31 or 32, can be adjusted in its height.

To this end, it is preferred that the pair of through holes 41 through which the pair of bolts 5 pass, are defined in the form of slots which extend in a longitudinal direction, thereby to enable a fastened height of the safety plate 4 to be adjusted.

Figure 2:
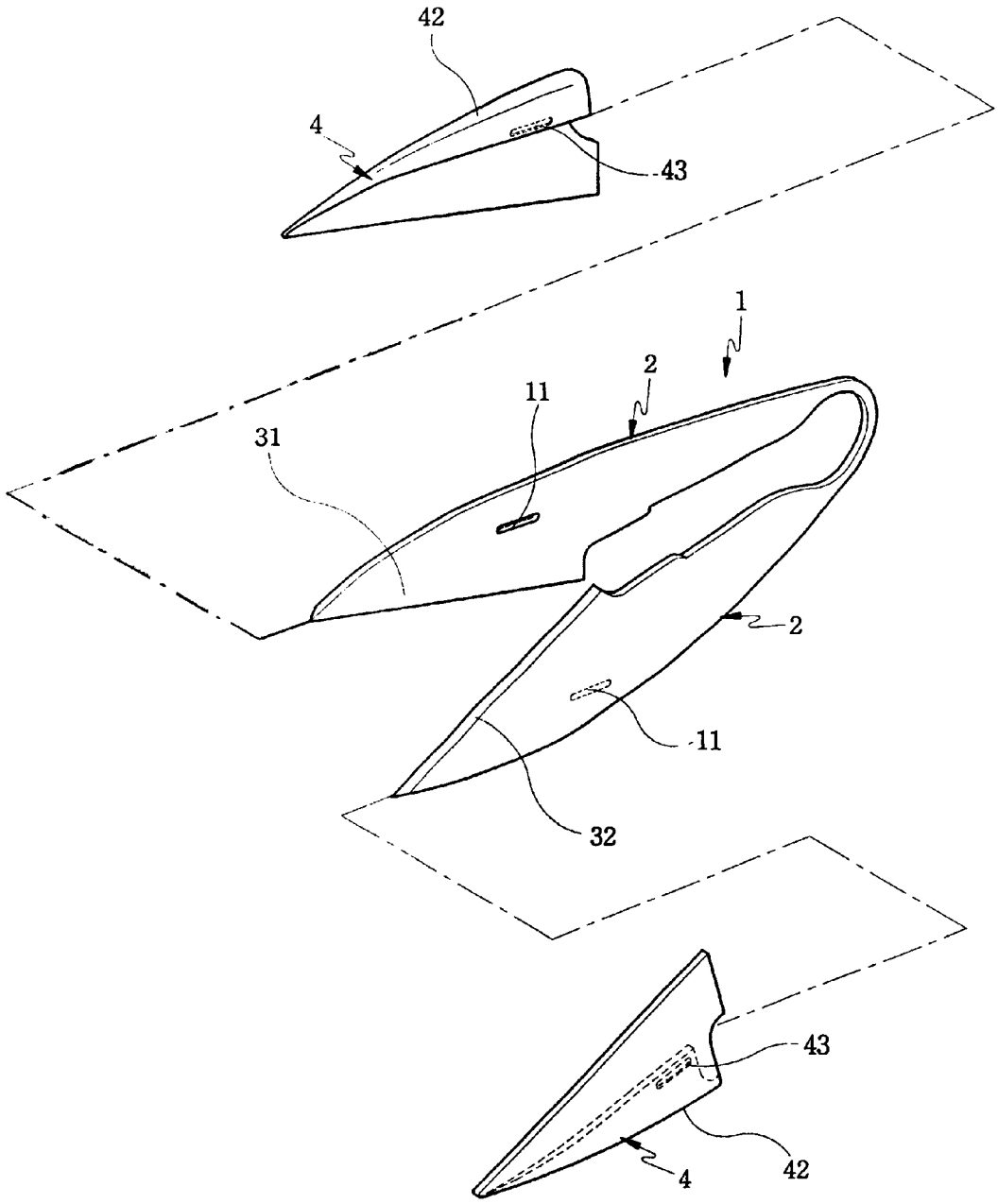
FIG. 2 is an exploded perspective view illustrating a scissor in accordance with a second embodiment of the present invention.
Figure 3:
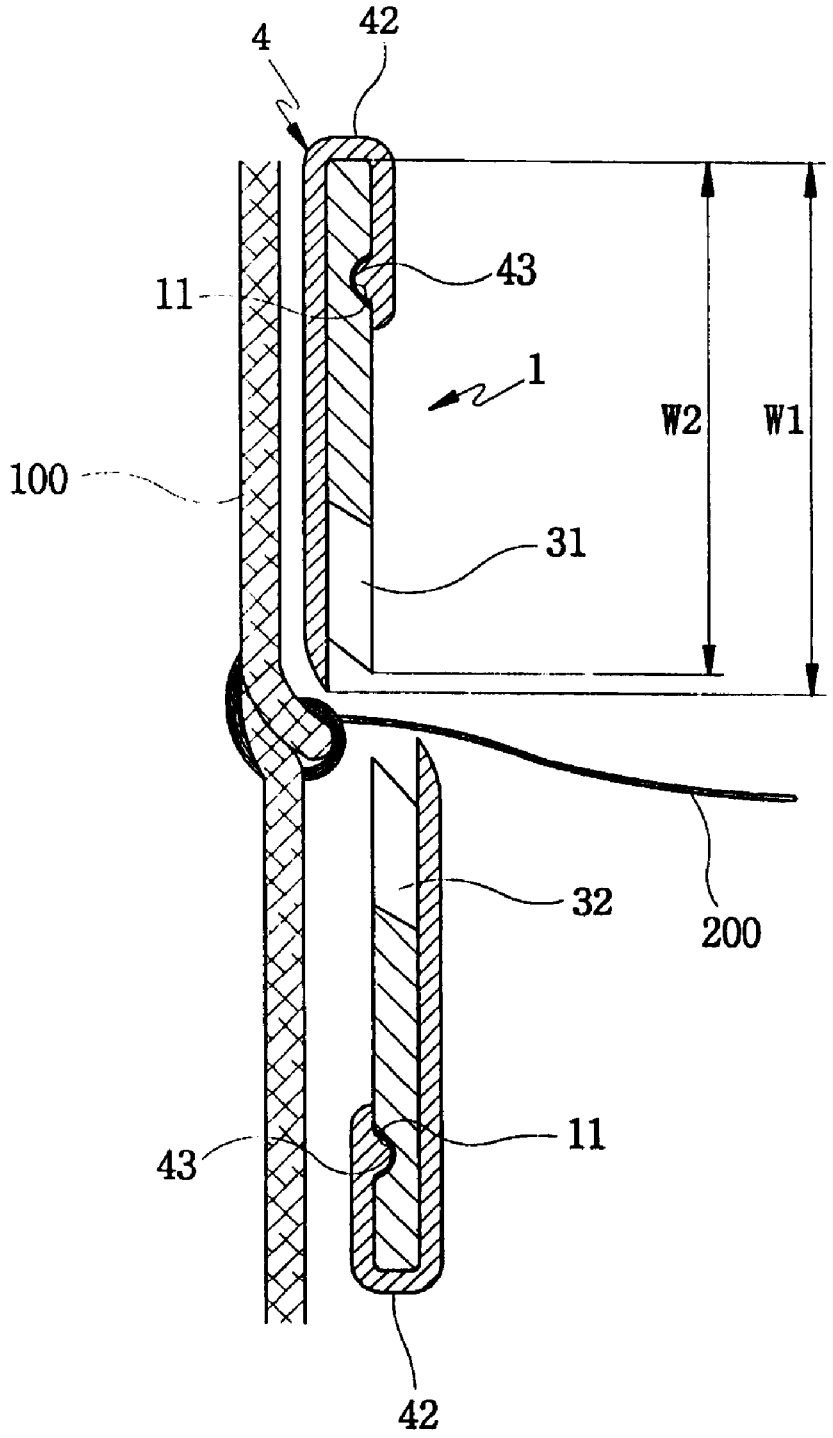
FIG. 3 is an enlarged cross-sectional view illustrating an operating structure of the scissor according to the present invention.

FIG. 2 is an exploded perspective view illustrating a scissor in accordance with a second embodiment of the present invention; and FIG. 3 is an enlarged cross-sectional view illustrating an operating structure of the scissor according to the present invention.

In this second preferred embodiment of the present invention, the fastening means for fastening each safety plate 4 to each blade section 31 or 32 serves as snap fitting means. It is preferred that the snap fitting means comprises a fitting groove 11 which is defined in one of the safety plate 4 and the blade section 31 or 32 and a protrusion 43 which is formed on the other of the safety plate 4 and the blade section 31 or 32. In this second preferred embodiment of the present invention, the fitting groove 11 is defined in the blade section 31 or 32 and the protrusion 43 is formed on the safety plate 4. In this regard, it is preferred that the fitting groove 11 and the protrusion 43 are elongated in a transverse direction or a plurality of fitting grooves 11 and a plurality of protrusions 43 are provided, thereby allowing the safety plate 4 to be securely fastened to the blade section 31 or 32.

In addition, it is preferred that the safety plate 4 is formed to have a length and a height enough to sufficiently cover a pointed tip and a sharp edge of each blade section 31 or 32, thereby preventing a safety issue from arising due to the fact that the pointed tip and the sharp edge of each blade section 31 or 32 are exposed to the outside. In other words, it is preferred that a height Wl of the safety plate 4 equals to or is larger than a height W2 of the blade section 31 or 32.

As can be readily seen from FIGS. 2 and 3, in this second preferred embodiment of the present invention, a squeezing portion 42 which has a wide surface area, is formed on an upper end of each safety plate 4. Accordingly, because the squeezing portion 42 is formed to have a relatively large width, it is possible to implement squeezing operations for the pair of blade sections 31 and 32 in a convenient manner without experiencing pains.

That is to say, when cutting by squeezing together the pair of blade sections 31 and 32 of the scissor 1 against an object to be cut, the thumb and the index finger are usually positioned on upper ends of the pair of blade sections 31 and 32, respectively. In this connection, in the conventional scissor, because the upper ends of the blade sections 31 and 32 are not so thick, pains can be induced to the thumb and the index finger when performing a multitude of thread-cutting operations. On the contrary, in the present invention, because the squeezing portion 42 which has a large width, is formed on the upper end of each safety plate 4, thread-cutting operations can be implemented in a more convenient and easier manner.

In the present invention, when removing a waste portion 200 of thread, which is exposed to the outside after fabric 100 is sewn, using the scissor 1 constructed as mentioned above, the fabric 100 is separated from the pair of blade sections 31 and 32 by a distance which corresponds to a thickness of the safety plates 4. Consequently, when the waste portion 200 of the thread is removed by the scissor 1, the blade sections 31 and 32 are prevented from being brought into contact with the fabric 100, and by this, the fabric 100 is not likely to be cut by the pair of blade sections 31 and 32.

The above-stated construction of the scissor according to the present invention can also be applied to scissors which are structured in a manner such that a pair of scissor members each having a gripping section and a blade section are cross-coupled with each other by a hinge shaft.

As a result, the scissor according to the present invention provides advantages in that, since fabric and a pair of blade sections are separated from each other by a distance which corresponds to a thickness of a pair of safety plates, the fabric is prevented from being cut by the pair of blade sections, whereby the generation of inferior goods can be avoided. Furthermore, due to the fact that the pair of blade sections are effectively covered by the pair of safety plates, respectively, it is possible to prevent a worker from being damaged by pointed tips and sharp edges of the pair of blade sections.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A scissor, comprising:

a pair of gripping sections integrally coupled with each other at one end thereof;

a pair of blade sections formed at the other end of the pair of gripping sections, respectively;

a pair of safety plates each securely fastened to a respective outer surface of the pair of blade sections, for separating fabric or sheet material from the pair of blade sections; and fastening means for fastening each safety plate to each blade section, said fastening means comprising a pair of slots which are defined in each safety plate, a pair of threaded holes which are defined in each blade section, and a pair of bolts which are screwed into the pair of threaded holes after passing through the pair of slots.

2. A scissor, comprising:

a pair of gripping sections integrally coupled with each other at one end thereof;

a pair of blade sections formed at the other end of the pair of gripping sections, respectively;

a pair of safety plates each securely fastened to a respective outer surface of the pair of blade sections, for separating fabric or sheet material from the pair of blade sections; and fastening means for fastening each safety plate to each blade section, said fastening means comprising a fitting groove which is defined in one of the safety plate and the blade section and a protrusion which is formed on the other of the safety plate and the blade section and is snap-fitted into the fitting groove.

3. The scissors as claimed in claim 2, wherein each safety plate has a squeezing portion which covers a flat edge of each blade section, which is opposite to a sharp edge of each blade section, the squeezing portion being enlarged in its surface area.

* * * * *